US005620550A

United States Patent [19]

Andersson et al.

[11] Patent Number: 5,620,550

[45] Date of Patent: Apr. 15, 1997

[54] PACKAGING MATERIAL WITH AN OPENING ARRANGEMENT AND A METHOD OF PRODUCING SAME

[75] Inventors: Ingvar Andersson, Löddeköpinge; Thorbjörn Andersson, Södra Sandby, both of Sweden

[73] Assignee: Tetra Laval Holdings & Finance S.A., Pully, Switzerland

[21] Appl. No.: 307,431

[22] Filed: Sep. 19, 1994

Related U.S. Application Data

[63] Continuation of Ser. No. 36,278, Mar. 24, 1993, abandoned.

[30] Foreign Application Priority Data

Mar. 31, 1992 [SE] Sweden ..... 9200999

[51] Int. Cl.[6] ..... B32B 31/04; B65B 61/20; B65D 41/00

[52] U.S. Cl. ..... 156/252; 156/250; 156/256; 53/133.1; 53/133.3; 53/133.5; 53/412; 220/265; 220/269; 220/359

[58] Field of Search ..... 53/412, 420, 131.3, 53/131.4, 131.5, 133.1, 133.2, 133.5, 133.8; 229/123.1, 123.2, 125.15, 215, 216, 217, 248, 924, 925, 926; 220/269, 265, 359; 156/69, 252, 256, 250

[56] References Cited

U.S. PATENT DOCUMENTS

| | | | |
|---|---|---|---|
| 3,658,238 | 4/1972 | Nedstedt . | |
| 3,690,509 | 9/1972 | Kinoian et al. | 229/123.2 X |
| 4,164,303 | 8/1979 | Waterbury | 220/359 |
| 4,258,876 | 3/1981 | Ljungcrantz . | |
| 4,266,993 | 5/1981 | Olsen . | |
| 4,391,385 | 7/1983 | Rausing . | |
| 4,399,924 | 8/1983 | Nilsson . | |
| 4,538,396 | 9/1985 | Nakamura | 53/412 |
| 4,585,498 | 4/1986 | Lagerstedt et al. . | |
| 4,595,116 | 6/1986 | Carlsson . | |
| 4,730,769 | 3/1988 | Stark | 229/125.15 |
| 4,796,760 | 1/1989 | Rausing . | |
| 4,819,839 | 4/1989 | Carlsson et al. . | |
| 4,830,273 | 5/1989 | Kalberer et al. | 229/125.15 X |
| 4,986,465 | 1/1991 | Jacobsson et al. . | |
| 5,049,336 | 9/1991 | Sjöström . | |
| 5,068,005 | 11/1991 | Lindskog et al. | 229/125.15 X |

FOREIGN PATENT DOCUMENTS

| | | |
|---|---|---|
| 0001134 | 3/1979 | European Pat. Off. . |
| 2729383 | 1/1978 | Germany . |
| 419327 | 5/1981 | Sweden . |

*Primary Examiner*—David A. Simmons
*Assistant Examiner*—M. Curtis Mayes
*Attorney, Agent, or Firm*—Burns, Doane, Swecker & Mathis L.L.P.

[57] ABSTRACT

A packaging material for producing packages includes a foundation layer that is provided with a through hole. A thermoplastic strip covers the through hole and an outer layer completely covers the thermoplastic strip and foundation layer. Various other layers can also be laminated to the foundation layer. When the thermoplastic strip is torn off, the various other layers accompany the thermoplastic strip, thereby exposing the through hole.

21 Claims, 1 Drawing Sheet

PACKAGING MATERIAL WITH AN OPENING ARRANGEMENT AND A METHOD OF PRODUCING SAME

This application is a continuation of application Ser. No. 08/036,278, filed Mar. 24, 1993 now abandoned.

TECHNICAL FIELD

The present invention relates to a packaging material and more particularly, to a packaging material with an opening arrangement comprising a prepared pouring aperture. The invention also relates to a method of producing such a packaging material.

BACKGROUND ART

There are many requirements to be satisfied when providing a single use disposable package, of the type manufactured from a continuous material web or an individual package blank, with an opening arrangement. The opening arrangement must be easy to apply to the package. It must be easy to open and the consumer must be able to ensure that no-one has tampered with the package. In addition, the opening arrangement should not disrupt the path of the material web through the filling machine. In many respects, this has been achieved by exteriorly providing the package with a strip that is intended to be torn off when the package is opened, a so-called pull-tab.

The strip is normally applied in the filling machine, which thus necessitates register maintenance and additional workstations in the filling machine. Furthermore, an exteriorly located strip may cause problems when the package passes through the sterile bath with which aseptic filling machines are equipped, since residual products may remain on the edges of the strip. Even though the strip is made from a thin material, it still constitutes an additional structure on the packaging material, which may occasion problems in feeding the material web through the filling machine. Such a strip is as good as tamper-proof, but can nevertheless be manipulated.

OBJECTS OF THE INVENTION

One object of the present invention is to produce a packaging material with an integrated opening arrangement in which the opening arrangement is completely protected by the packaging material, and thereby also completely protected against unauthorized opening. The packaging material according to the present invention displays an almost homogeneous surface which does not disrupt the feeding of the material web through the filling machine and which cannot constitute a problem on passage through the sterile bath of the filling machine.

A further object of the present invention is to realize a packaging material with an opening arrangement which enjoys all of the favourable properties possessed by prior art pull-tab opening arrangements.

SOLUTION

These and other objects have been attained according to the present invention in that a packaging material is provided with a pouring aperture. The pouring aperture is covered by a strip which is located beneath an outer layer and which is disposed, on opening, to expose the pouring aperture.

BRIEF DESCRIPTION OF THE ACCOMPANYING DRAWINGS

Preferred embodiments of the present invention will now be described in greater detail hereinbelow, with particular reference to the accompanying Drawings, in which:

FIG. 1 is a cross-sectional view of one embodiment of the present invention, FIG. 2 is a perspective view of the embodiment of the present invention shown in FIG. 1 applied on a package container;

The present invention shown in FIG. 3 is a cross-sectional view of another embodiment of the present invention; and FIG. 4 is a top plan view of the embodiment of FIG. 3.

The Drawings show only those details essential to an understanding of the present invention.

DESCRIPTION OF PREFERRED EMBODIMENTS

Figure 1:
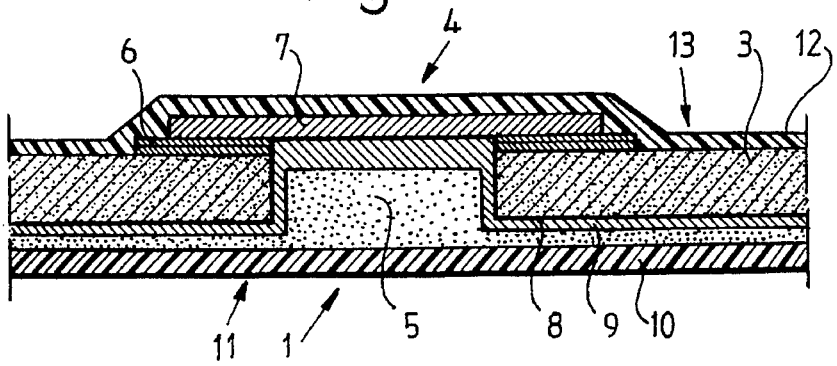
Figure 2:
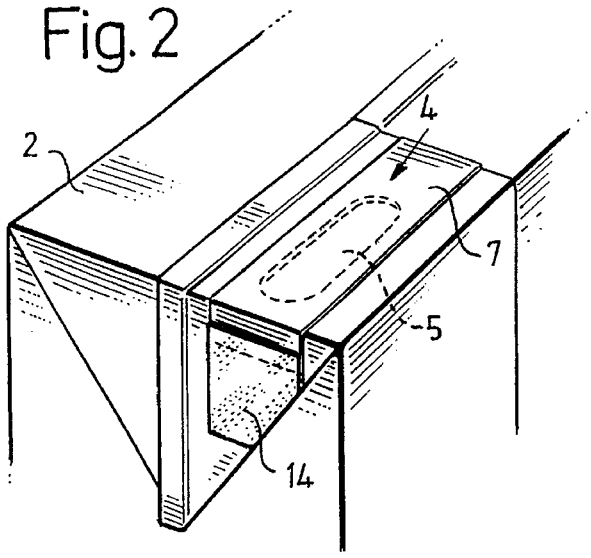

FIGS. 1 and 2 show a first embodiment of the present invention. The packaging material 1 which is employed to produce single-use disposable packages 2 manufactured from a continuous web or individual package sheets or blanks often consists of a laminate with a core layer 3 of cardboard or paper. FIG. 1 shows a cross section through such a laminate provided with an opening arrangement 4 according to the invention.

As the foundation of the packaging laminate, use is made of the core layer 3 of cardboard or paper. This layer is provided with fold indications, so-called crease lines. In the same tool which makes the crease lines, it is possible to house a complete punching unit. By such means, additional register maintenance will be avoided and those holes which are to form the pouring aperture 5 (i.e., prepared pouring aperture) of the opening arrangement 4 are already punched in the uncoated paper material web.

The core layer 3 of the packaging material web 1 is provided, around the punched hole 5, with an adhesive layer 6 which can be applied in a so-called ink unit. Alternatively, the adhesive layer 6 can be placed on a strip 7 which is to cover the punched hole 5. The thin strip 7 is thereafter placed so that it covers the hole 5 and is secured against the core layer 3 of the packaging material web 1 with the aid of the adhesive layer 6, irrespective of whether this is pre-applied to the material web 1 or integrated in the strip 7. Such a strip 7 can be secured on a material web 1 which has an outer layer of thermoplastic or fusible core layer 3, by means of heat sealing.

The strip 7 consists of a thin plastic material which is normally laminated such that the core layer consists of a tear-resistant plastic material on both sides laminated with a thermoplastic. Other technical solutions are also conceivable employing materials which combine fusibility and a high tear index.

In order to facilitate tearing off of the strip 7 upon opening of the package 2, the one end of the strip 7 may be provided with an anti-adhesive coating. The anti-adhesive coating is placed on the strip 7 on a small area at that end of the strip 7 where the tearing-off operation is to be commenced.

Once the strip 7 has been applied to the core layer 3 of the packaging material web 1, the packaging material 1 is finished by being provided with one or more inner layers which may consist of a bond layer 8 of thermoplastic and an aluminium foil layer 9, as well as an additional thermoplastic layer 10, which forms the surface of the packaging material 1 facing the contents of the package and hereafter designated the opposed side 11 of the packaging material 1. The packaging material is further provided with an outer layer 12 normally consisting of a thermoplastic. The strip 7 will wholly be covered by this thermoplastic layer 12. The thermoplastic layer 12 forms the surface of the packaging material 1 facing away from the contents of the package and hereafter designated the reverse side 13 of the packaging material 1.

A packaging material 1 has now been obtained with an integrated opening arrangement 4. This packaging material 1 easily runs through the filling machine without causing any problems resulting from residual products in the sterile bath. The packaging material 1 is formed into a tube, filled with liquid food, and transversely sealed into individual packages 2 which are then cut off and finally formed. In order to facilitate opening of the opening arrangement 4 according to the invention, the finished package 2 can, after final forming, be provided with an exterior gripping strip 14 fixedly sealed over a portion of the interiorly applied plastic strip 7. The gripping strip 14 suitably carries print in a different colour so as to indicate where the opening procedure is to take place.

Figure 3:
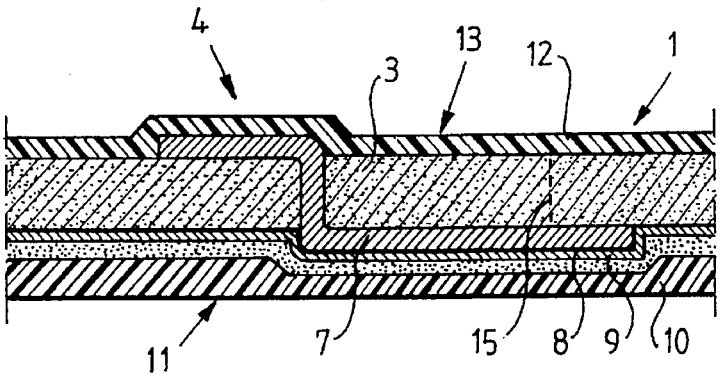
Figure 4:
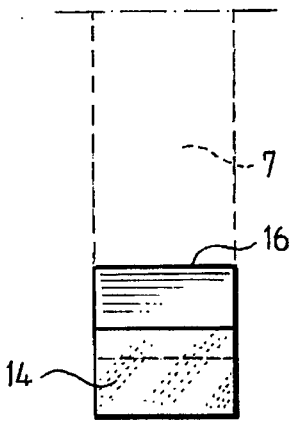

FIGS. 3 and 4 show a second embodiment of the present invention. Also in this embodiment, the point of departure is the core layer 3 of the packaging material 1, the core consisting of cardboard or paper. In the tool where the crease lines are formed, a hole indication 15 (i.e., prepared pouring aperture) is also made by perforating the core layer 3. The width of the hole indication 15 should correspond to the width of the strip 7 which is to be applied on the core layer 3. The one short side of the hole indication 15 is provided with a completely penetrating slit 16.

The strip 7 is applied in the same manner as described above, by an adhesive layer 6 or by heat sealing, but the strip 7 is placed on the opposed side 11 of the packaging material 1. Once a part of the strip 7 has been applied against the core layer 3, the remaining part of the strip 7 is passed through the slit 16 in the short side of the hole indication 15 and that part of the strip 7 which then arrives at the reverse side 13 of the packaging material is folded along the surface of the reverse side 13. The packaging material 1 is finished in the customary manner, with different laminate layers as shown in FIG. 3. The same second embodiment is illustrated in top plan view in FIG. 4. Here, the finished packaging material 1 has been exteriorly provided with a gripping strip 14 which indicates where the tearing-off operation is to be commenced.

When the opening arrangement 4 according to the invention is opened, the strip 7 located inside the outer thermoplastic layer 12 is torn off, commencing at the gripping strip which is applied on the outside of the package 2. When the strip 7 placed inside the thermoplastic layer 12 is torn off, it draws with it the layer or layers to which it is sealed so that the hole 5 is exposed and the contents of the package 2 can be poured out. The layers to which the strip 7 is sealed are at least one in number, namely the thermoplastic layer 12 which covers the strip 7, but may, depending upon the construction of the packaging material 1, consist of a plurality of layers. In the second embodiment, the hole indication 15 in the core layer 3 to which the strip 7 is connected also accompanies the strip when torn off. This hole indication 15 can be employed for reclosing in that it is once again pressed down in the hole 5 which is exposed when the strip 7 is torn off.

The strip 7 is easy to tear off, in that the outer thermoplastic layer 12 is partly weakened at the edges of the strip 7 where the outer thermoplastic layer 12 is somewhat thinner on application. In order further to improve the tearing off operation, these edges can moreover be weakened by heat treatment.

An opening arrangement 4 according to the present invention can also be applied to other materials in web or sheet form, in which the carrier or base consists of another material than paper or cardboard. These packaging materials 1 are provided with punched holes 5 which are covered by a strip 7, whereafter the strip 7 is completely or partly covered with an outer thermoplastic layer 12. The outer thermoplastic layer 12 can wholly cover the strip 7 but only partly cover the finished packaging container 2.

Other designs of such a strip 7 are also possible. For example, the packaging material 1 can be provided with a strip 7 according to the invention in the transverse sealing region (a so-called spout strip), this strip entraining the layer to which it is sealed when torn off. In such instance, a small section of the transverse seal joint is opened and forms an opening and pouring arrangement. In addition, such a strip 7 can be employed for realizing a pull-tab integrated in the packaging material 1, in which the material 1 is vacuum-shaped into a pipe or socket in a later process, possibly provided with threads for cooperation with an outer screw cap.

Another form of opening arrangement in which the strip 7 according to the invention can be employed is that type of strip 7 which passes around the package 2. In this instance, the strip 7 takes with it all of those surfaces which are sealed to the strip 7 and by such means opens the package 2.

As will have been apparent from the foregoing description, the present invention realizes a packaging material with a wholly integrated opening arrangement which lies completely protected before being opened and which cannot be improperly opened or tampered with in any way. The packaging material is completely ready for the filling machine without the filling machine needing further workstations for hole making and applying pull-tab strips.

The present invention should not be considered as restricted to that described above and shown on the Drawings, many modifications being conceivable without departing from the spirit and scope of the appended Claims.

What is claimed is:

1. A method of producing a packaging material with an opening arrangement for use in producing a package which holds contents and which possesses an outer surface facing away from the contents comprising: providing a core layer of material having oppositely facing first and second surfaces; forming a prepared pouring aperture in the core layer; covering the prepared pouring aperture with a material strip that is sealed to the core layer so that upon tearing-off of the material strip a pouring aperture is exposed; and completely covering at least a first portion of the material strip with an outer layer by sealing the outer layer to the material strip and to the first surface of the core layer, the outer layer forming the outer surface of the package when the packaging material is subsequently formed into a package.

2. The method of producing a packaging material as claimed in claim 1, wherein the first surface of the core layer is provided with an adhesive layer prior to sealing the material strip to the core layer, the adhesive layer serving to seal the material strip to the core layer.

3. The method of producing a packaging material as claimed in claim 1, including providing the material strip with an adhesive layer before sealing the material strip to the core layer, the adhesive layer serving to seal the material strip to the core layer.

4. The method of producing a packaging material as claimed in claim 1, including sealing more than one inner layer to the second surface of the core layer after the material strip has been sealed to the core layer.

5. The method of producing a packaging material as claimed in claim 1, wherein the prepared pouring aperture is formed in the core layer by perforating the core layer with a hole indication that includes a slit along one side which extends completely through the core layer, and including sealing a second portion of the material strip to the core layer and passing the first portion of the material strip through the slit in the core layer before the first portion of the material strip is covered by the outer layer.

6. The method of producing a packaging material as claimed in claim 1, wherein said step of forming a prepared pouring aperture in the core layer includes forming a prepared pouring aperture in at least a core layer that includes at least paper material.

7. The method of producing a packaging material as claimed in claim 1, including sealing a gripping strip to the outer layer so that at least a portion of the gripping strip overlies at least a portion of the material strip.

8. Packaging material provided with an opening arrangement for use in producing a package which holds contents and which possesses an outer surface facing away from the contents comprising: a core layer, a prepared pouring aperture formed in the core layer, a material strip covering the prepared pouring aperture and being disposed to expose a pouring aperture upon tearing-off of the material strip, said material strip being completely covered by an outer layer that forms the outer surface of the package when the packaging material is subsequently formed into a package, said outer layer being sealed to the material strip and to the core layer.

9. The packaging material as claimed in claim 8, wherein said material strip is sealed to at least an outer surface of the core layer, and including a thermoplastic layer sealed to an inner surface of the core layer opposite the outer surface.

10. The packaging material as claimed in claim 8, wherein the material strip is provided with an outer gripping strip that is sealed to the material strip.

11. The packaging material as claimed in claim 8, wherein the core layer comprises one of cardboard and paper, and said core layer is the only layer provided with an aperture.

12. The packaging material as claimed in claim 8, wherein the prepared pouring aperture includes a perforated hole indication having a slit extending along one side that extends completely through the core layer, a portion of said outer layer being located on one side of said core layer and another portion of the material strip being located on an opposite side of the core layer, the material strip extending through the slit in the core layer so that upon tearing-off of the material strip a portion of the core layer surrounded by the hole indication is separated from surrounding portions of the core layer to expose a pouring aperture.

13. The packaging material as claimed in claim 8, wherein the material strip is a laminate.

14. The packaging material as claimed in claim 8, wherein one end of the material strip is not sealed to subjacent layers.

15. The packaging material as claimed in claim 8, wherein one end of the material strip is provided with an anti-adhesive coating.

16. A packaging material for producing packages, comprising a core layer of paper material having oppositely facing first and second surfaces, a prepared pouring aperture formed in the core layer of paper material, a material strip covering the prepared pouring aperture while also being removable during a tearing-off operation to expose a pouring aperture, said material strip being separate from the core layer, at least a portion of the material strip being sealed to a first surface of the core layer, an outer layer that forms an outer surface of the packaging material, the outer layer being in contact with and sealed to the first surface of the core layer of paper material and completely covering the material strip, said outer layer being sealed to the material strip, at least a portion of the material strip being located between the core layer and the outer layer, and at least one inner layer sealed to the second surface of the core layer.

17. The packaging material according to claim 16, wherein the core layer is one of paper and cardboard, said inner layer being an aluminum foil layer, and including a thermoplastic layer sealed to the aluminum foil layer.

18. The packaging material according to claim 17, wherein a portion of the material strip is positioned on a side of the core layer opposite the side on which the outer layer is positioned.

19. The packaging material according to claim 17, wherein said material strip is secured to said core layer by an adhesive layer and including means for indicating where the tearing-off operation is to commence.

20. The packaging material according to claim 17, wherein the material strip comprises a tear-resistant plastic material laminated on opposite sides with thermoplastic material.

21. The packaging material according to claim 16, wherein said prepared pouring aperture includes a perforated hole indication in the core layer having a slit along one side that extends completely through the core layer, said material strip extending through the slit so that portions of the material strip are positioned on opposite sides of the core layer.

* * * * *